US005788772A

United States Patent [19]

Kunieda et al.

[11] Patent Number: 5,788,772

[45] Date of Patent: Aug. 4, 1998

[54] APPARATUS FOR COATING THE EXTERIOR OF ROD-LIKE MEMBERS

[75] Inventors: Shigehiko Kunieda, Iwakura; Kimihiko Matsuzaki; Michio Sekiguchi, both of Nagoya, all of Japan

[73] Assignee: NGK Insulators, Ltd., Japan

[21] Appl. No.: 676,507

[22] Filed: Jul. 8, 1996

[30] Foreign Application Priority Data

Jul. 12, 1995 [JP] Japan ..... 7-176434

[51] Int. Cl.[6] ..... B05C 11/00

[52] U.S. Cl. ..... 118/264; 118/265; 118/266; 118/208; 118/209; 118/DIG. 11

[58] Field of Search ..... 118/264, 265, 118/266, 208, 209, 58, 66, 712, DIG. 11

[56] References Cited

U.S. PATENT DOCUMENTS

| | | | |
|---|---|---|---|
| 2,987,955 | 6/1961 | Sassenberg | 118/264 |
| 4,174,243 | 11/1979 | Magarian | 118/DIG. 11 |
| 4,475,294 | 10/1984 | Henricks | 118/58 |
| 4,604,300 | 8/1986 | Keys et al. | 118/266 |
| 4,655,230 | 4/1987 | Bryant et al. | 118/264 |
| 4,865,872 | 9/1989 | Pellatiro | 118/712 |
| 4,995,934 | 2/1991 | Janatka | 118/266 |
| 5,482,554 | 1/1996 | Perings et al. | 118/DIG. 11 |

*Primary Examiner*—Peter Chin
*Assistant Examiner*—Michael P. Colaianni
*Attorney, Agent, or Firm*—Parkhurst & Wendel

[57] ABSTRACT

A coating apparatus for coating an outer peripheral surface of a rod-shaped workpiece with a covering material, comprising an elastic body having a covering material-impregnatable property and provided with an insertion hole through which the workpiece is to be passed, and a moving mechanism for moving the workpiece relative to the elastic body through the insertion hole, wherein the outer peripheral surface of the workpiece is coated with the covering material impregnated in the elastic body, when the workpiece is passed through the insertion hole of the elastic body by the moving mechanism.

12 Claims, 8 Drawing Sheets

APPARATUS FOR COATING THE EXTERIOR OF ROD-LIKE MEMBERS

BACKGROUND OF THE INVENTION

1. Field of the Invention

The present invention relates to a covering material-coating apparatus and a covering material-coating method.

2. Related Art of the Invention

Heretofore, for example, when a lightning-guard insulator apparatus is to be assembled or produced, a lightning arresting element is placed in an insulating cylinder made of a fiber-reinforced plastic (FRP), and electrode fittings are attached to both ends of the insulating cylinder. A covering material such as a primer (an undercoat such as an adhesive) is coated around the outer periphery of the insulating cylinder, and then an insulating housing is molded of silicone rubber or the like around the insulating cylinder.

When the coating material such as a primer is to be applied to the outer periphery of the insulating cylinder at the time of assembling such a lightning-guard insulator, it is a conventional practice that while a worker is turning the insulating cylinder successively by 120°, a gauze impregnated with the primer is contacted with the insulating cylinder and moved thereon in the circumferential and longitudinal directions to manually effect the coating by three times. When no primer-coated portion is to be formed around the outer periphery of each of the opposite ends of the insulating cylinder corresponding to the electrode fittings, the coating is effected in the state that a masking tape is adhered there.

However, according to the above conventional process, since the primer is manually applied to the workpiece, the coating work is time-consuming, and it is difficult to uniformly coat the primer on the outer peripheral surface of the workpiece.

Further, according to the above conventional process, since the masking tape is adhered to those outer peripheral end portions of the workpiece where no primer is to be coated, it is troublesome and time-consuming to adhere or remove the tape.

SUMMARY OF THE INVENTION

The present invention has been accomplished with due attention to the problems existing as in the above incoventional technique. A principle object of the present invention is to provide a covering material-applying apparatus and a covering material-applying process which can efficiently and uniformly apply the covering material upon the outer periphery of a rod-shaped workpiece.

Another object of the present invention is to provide a covering material-applying apparatus which can easily form an outer peripheral end portion of the workpiece where no coating material is applied.

In order to accomplish the above objects, the coating apparatus according to the present invention for coating an outer peripheral surface of a rod-shaped workpiece with a covering material, comprises an elastic body having a covering material-impregnatable property and provided with an insertion hole through which the workpiece is to be passed, and a moving mechanism for moving the workpiece relative to the elastic body through the insertion hole, wherein the outer peripheral surface of the workpiece is coated with the covering material impregnated in the elastic body, when the workpiece is passed through the insertion hole of the elastic body by the moving mechanism.

Further, the present invention is to provide a process for coating an outer peripheral surface of a rod-shaped workpiece with a covering material by inserting the workpiece through an insertion hole formed in a central portion of elastic body and moving the workpiece relative to the elastic body in a longitudinal direction of the workpiece.

According to the apparatus and the process for coating the outer periphery surface of the workpiece with the covering material in the present invention mentioned above, the rod-shaped workpiece is passed through the insertion hole of the elastic body impregnated with the covering material such as a primer, in this state the workpiece is moved relative to the elastic body in the longitudinal direction of the workpiece by the workpiece-moving mechanism, and thereby the outer peripheral surface of the workpiece is coated with the covering material impregnated into the elastic body. Therefore, the outer peripheral surface of the workpiece can be coated with the covering material in a short time to enhance the workability. Further, the outer peripheral surface of the workpiece can be uniformly coated with the covering material to enhance the quality of the product.

In the following, preferred embodiments of the present invention will be explained. Any of these preferred embodiments may be combined together unless any unacceptable effect occurs.

(1) The coating apparatus further comprises a rotating mechanism for rotating the workpiece. In this case, the outer peripheral surface of the workpiece is coated with the covering material by moving the workpiece relative to the elastic body through the insertion hole in the longitudinal direction of the workpiece, while the workpiece is being rotated by the rotating mechanism. Therefore, the outer peripheral surface of the workpiece can be more uniformly coated with the covering material in a shorter time period. Thereby, the workability and the product quality can be further enhanced.

(2) The coating apparatus comprises a workpiece detecting mechanism for detecting an end portion of the workpiece and outputting a detection signal upon detection of said end portion of the workpiece so that the workpiece-moving mechanism may be stopped at a place corresponding to a location where the the elastic body is spaced from the end portion of the workpiece by a given distance, thereby to stop the relative movement between the workpiece and the elastic body and to not coat an outer peripheral surface of the end portion of the workpiece with the covering material. In this case, the sensor detects the end portion of the workpiece and outputs the detection signal when the workpiece comes to the place corresponding to a location where the the elastic body is spaced from the end portion of the workpiece by a given distance. Thereby, the relative movement between the workpiece is stopped and the elastic body to stop the coating action of the workpiece with the elastic body, and thereby an outer peripheral surface of the end portion of the workpiece not coated with the covering material is formed. Therefore, such an outer peripheral surface of the end portion of the workpiece not coated with the covering material can be easily formed with no use of a masking tape. Thereby, the workability can be largely enhanced.

(3) The elastic body includes two elastic members divided along the insertion hole so that said insertion hole may be opened by spacing the elastic members from each other. Since the elastic body is divided into two elastic members, the insertion hole can be opened along its longitudinal direction by spacing the elastic members from each other. Therefore, the workpiece can be easily attached to and detached from the insertion hole in the state that the insertion hole is kept opened.

(5) The elastic body is sandwiched by a sandwiching member from opposite sides of the elastic body as viewed in a moving direction of the workpiece, said sandwiching member being made of a material harder than the open-cell type sponge. In this case, the elastic body can be prevented from being deformed in shape during relative movement between the elastic body and the workpiece.

(6) The coating apparatus further comprises a vertically movably concaved cylindrical supporting roller having a recessed portion at a central portion of an outer periphery thereof, said supporting roller being adapted to support the workpiece coated with the covering material. In this case, as the the outer peripheral surface of the workpiece is coated with the covering material by moving the workpiece relative to the elastic body with the moving mechanism, the concaved cylindrical supporting roller is moved up to the workpiece-moving path to support the coated portion of the workpiece at the recessed portion of the central outer peripheral face of the supporting roller. Therefore, the coated workpiece can be supported by the supporting roller in the state that the coated surface of the workpiece is not largely touched. The term "concaved cylindrical supporting roller" means, for example, the shape shown in FIGS. 1, 2, 4 and 6 which is formed by joining two frusto-conical bodies at their smaller diameter portions.

(7) The coating apparatus further comprises a hot air generating mechanism arranged downstream the elastic body to dry the covering material coated upon the outer peripheral surface of the workpiece. In this case, after the outer peripheral surface of the workpiece is coated with the covering material by passing the workpiece through the insertion hole, hot air is fed upon the covering material-coated surface of the workpiece by the hot air generating mechanism. Therefore, the covering material coated upon the outer peripheral surface of the workpiece can be dried in a short time.

(8) The coating apparatus further comprises a workpiece feeding mechanism and a workpiece feeding guide mechanism, said workpiece feeding mechanism being adapted for feeding the workpiece to the elastic body and said workpiece feed guide mechanism being adapted for guiding a forward end of the workpiece of the workpiece into the insertion hole of the elastic body. In this case, the steps of feeding the workpiece to the elastic body and aligning and guiding the starting end of the workpiece to the insertion hole of the elastic hole can be easily effected without necessitating a large manual labor.

(9) The coating apparatus further comprises a chucking mechanism for chucking a forward end portion of the workpiece, said chucking mechanism being moved by said workpiece-moving mechanism to pass the workpiece through the insertion hole of the elastic body. In this case, the workpiece can be assuredly moved through the insertion hole of the elastic body to facilitate the coating operation.

(10) The coating apparatus further comprises a moving mechanism movement-detecting mechanism for detecting a location where the coating of the workpiece with the covering material through the insertion hole of the elastic body is to be terminated so as to stop the workpiece-moving mechanism. In this case, the coating step can be stopped at any arbitrary location of the workpiece, so that an end portion of the workpiece to which an end fitting is to be attached may be left uncoated with the covering material.

These and other objects, features and advantages of the invention will be appreciated upon reading of the following description of the invention when taken in conjunction with the attached drawings, with the understanding that some modifications, variations and/or changes could be easily made by the skilled person in the art to which the invention pertains.

BRIEF DESCRIPTION OF THE INVENTION

DETAILED DESCRIPTION OF THE INVENTION

Figure 1:
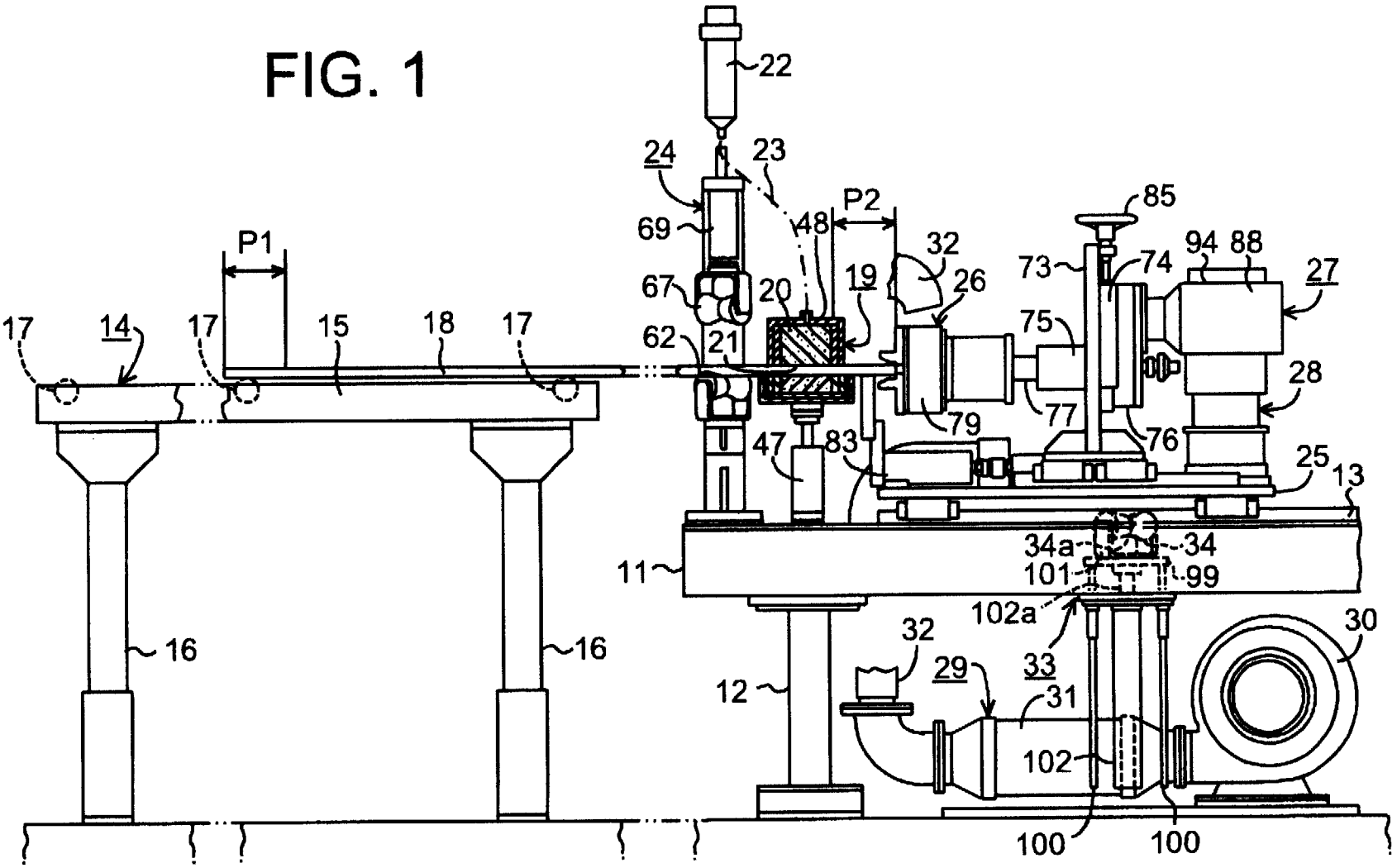
FIG. 1 is a front view of a principal portion of an embodiment of the covering material-coating apparatus according to the present invention.

An embodiment of the covering material-coating apparatus according to the present invention will be explained below with reference to the attached drawings.

First, this embodiment of the covering material-coating apparatus will be schematically explained with reference to FIGS. 1 to 3. As shown, a machine frame 11 extending horizontally is placed on a floor via plural supporting legs 12, and a pair of parallel rails 13 are horizontally laid on the upper surface of the machine frame 11 in a longitudinal direction. A workpiece feeding mechanism 14 is arranged on a forward side of the machine frame 11, and includes a conveyor frame 15 placed on the floor via plural supporting legs 16 and plural conveyor rollers 17 rotatably supported on the conveyor frame 15 at a given interval. A rod-shaped workpiece 18 having a circular section is supported on the conveyor rollers 17 of the workpiece feed mechanism 14 so that the workpiece 18 may be carried and fed above the machine frame 11.

Figure 3:
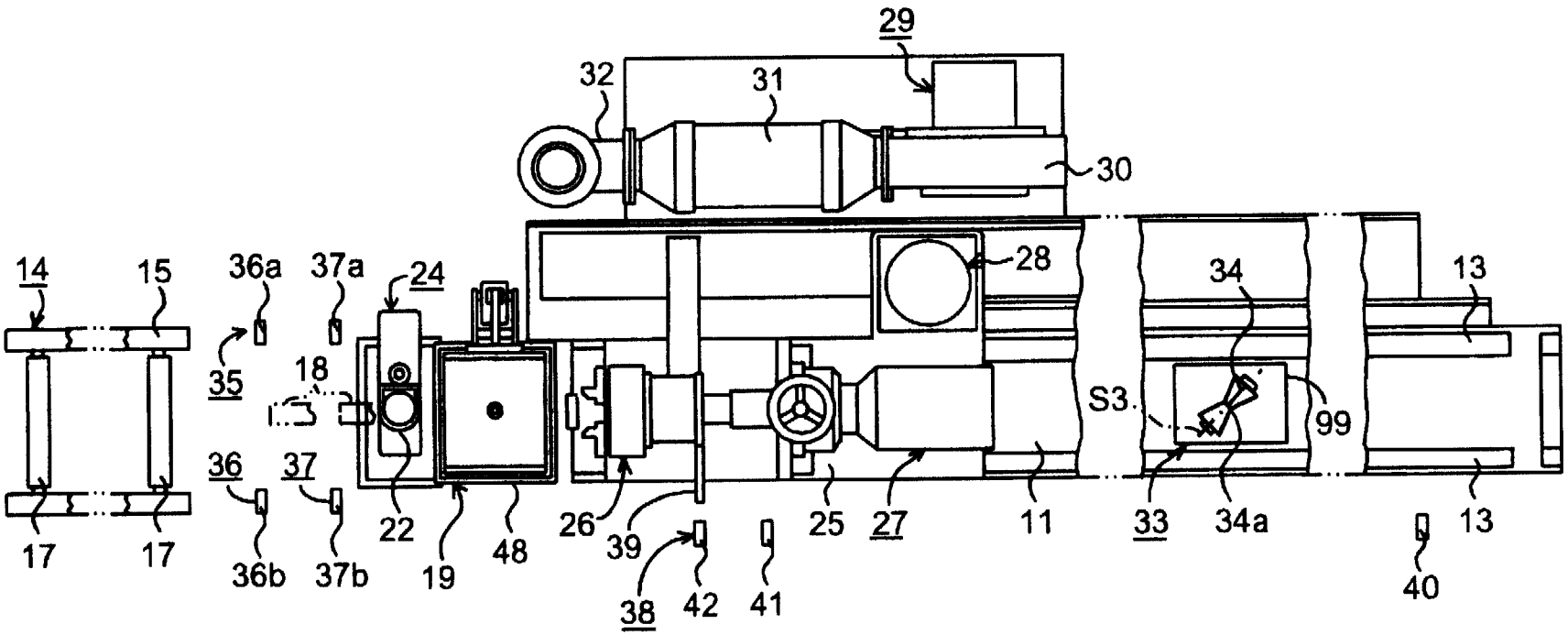
FIG. 3 is a plane view of the principal portion of the covering material-coating apparatus.

A coating mechanism 19 is provided at an upper face of a front end portion of the machine frame 11 (at the upper face of a left end portion in FIGS. 1 and 3). The coating mechanism 19 includes an elastic body 20 made of an open-cell sponge, which is provided in its central portion with a insertion hole 21 for inserting the workpiece 18 therethrough. For example, the insertion hole 21 has such a size that the elastic body 20 may press the outer periphery of the workpiece 18 at the inner peripheral wall of the insertion hole 21 during the passage of the workpiece through the insertion hole 21, while the elastic body 20 is not largely deformed near the insertion hole 21. A primer feed tank 22 is arranged near above the coating mechanism 19, and a primer as a covering material placed in the tank 22 is fed into the elastic body 20 via a feed pipe 23 so that the elastic body 20 may be impregnated with the primer. In this embodiment, as a primer is used a silicone rubber dissolved in an organic solvent such as toluene (tradename S2260 or SH2260 manufactured by Torey Dow Corning Silicone Co., Ltd.).

A feed/guide mechanism 24 for the workpiece 18 is arranged near in front of the coating mechanism 19, and guides the workpiece 18 through the insertion hole 21 of the elastic body 20. A moving table 25 is movably supported on a pair of the rails 13 of the machine frame 11, and above the moving table 25 are arranged a chucking mechanism 26, a turning mechanism 27 and a carrying mechanism 28 for the workpiece 18. A starting end portion of the workpiece 18 inserted through the insertion hole 21 of the elastic body 20 in the coating mechanism 19 is releasably chucked by the chucking mechanism 26. While the workpiece 18 is chucked by the chucking mechanism 26, the workpiece 18 is turned around its axis by the turning mechanism 27, and the moving table 25 is carried by the moving mechanism 28 in a rear direction (to a right side in FIGS. 1 and 3) to carry the workpiece 18 in the longitudinal direction. By so doing, the workpiece 18 is rotated and moved relative to the elastic body 20 through the through-hole 21, so that the primer impregnated into the elastic body 20 is applied around the outer periphery of the workpiece 18.

A hot air generating mechanism 29 is arranged under the front end portion of the machine frame 11, corresponding to the coating mechanism 19. The hot air generating mechanism 29 includes a blower 30 with a motor, a heater 31 connected to a discharge side of the blower 30, and a feed duct 32 connected to the heater 31 and opened above a rear side of the coating mechanism 19. After the primer is applied onto the outer periphery of the workpiece 18 by the coating mechanism 19, hot air generated in the heater 31 is blown upon the primer-coated surface of the workpiece 18 through the opening of the feed duct 32, thereby drying said coated surface.

A plurality of work-moving guide mechanisms 33 are provided at the machine frame 11 such that the mechanisms 33 may be located at a given interval along a moving path of the moving table 25. Each moving guide mechanism 33 includes a support roller 34 having a liftable concaved barrel shape 34 with an annular recess **34*a* on a central portion of the outer periphery. When the outer peripheral surface of the workpiece 18 is coated with the primer in the state that the workpiece is being moved by the moving mechanism 28 and every time the moving table 25 passes above the moving guide mechanism 33, the supporting rollers 34 are successively raised to support the workpiece 18 on the recesses 34*a***.

As shown in FIG. 3, the workpiece-detecting mechanism 35 is arranged in front of the feed guide mechanism 24, and includes a first sensor 36 and a second sensor 37. The first sensor 36 includes a light-emitting element **36*a* and a light-receiving element 36*b*, and the second sensor 37 includes a light-emitting element 37*a* and a light-receiving element 37*b*. The workpiece 18 is moved by the moving mechanism 28. When the terminal end of the workpiece 18 is moved to be opposed to the first sensor 36, the light-receiving element 36*b* outputs a detection signal, based on which a moving speed of the moving mechanism 28 is reduced. When the terminal end of the workpiece 18 is moved to be opposed to the second sensor 37, the light-receiving element 37*b* outputs a detection signal, based on which the moving mechanism 28 is stopped. By so doing, a portion P1 not coated with the primer as shown in FIG. 1 is formed around an outer periphery of the terminal end portion of the workpiece 18**.

As is seen in FIG. 1, after the workpiece 18 is set at the coating mechanism 19 and the chucking mechanism 26, the moving table 25 begins to be moved to make the coating mechanism 19 coat the workpiece 18 with the primer. Thus, a portion P2 not coated with the primer is formed at an outer periphery of the starting end portion of the workpiece 18.

As shown in FIG. 3, a movement detecting mechanism 38 for the moving table 25 is arranged corresponding to a moving path of the chucking mechanism 26. This movement detecting mechanism 38 includes a dog 39 projecting from the chucking mechanism 26 and first to third approach switches 40, 41 and 42 to be opposed to the dog 39. When the chucking mechanism 26 by which the workpiece 18 is chucked is moved to its movement terminal end by the moving mechanism 28, the dog 39 is opposed to the first approach switch 40 so that the first approach switch 40 may output a detection signal to restrict the location of the movement terminal end of the chucking mechanism 26.

As the chucking mechanism from which the workpiece 18 is released after being coated is returned from the location of its movement terminal end to its original location, the dog 39 is opposed to the second approach switch 41 so that the second approach switch 41 may output a detection signal to reduce a returning speed of the moving mechanism 28. Thereafter, when the dog 39 is opposed to the third approach switch 42, the third approach switch 42 outputs a detection signal to stop the returning movement of the moving mechanism 28.

Next, the above mentioned mechanisms will be explained in more detail.

Figure 4:
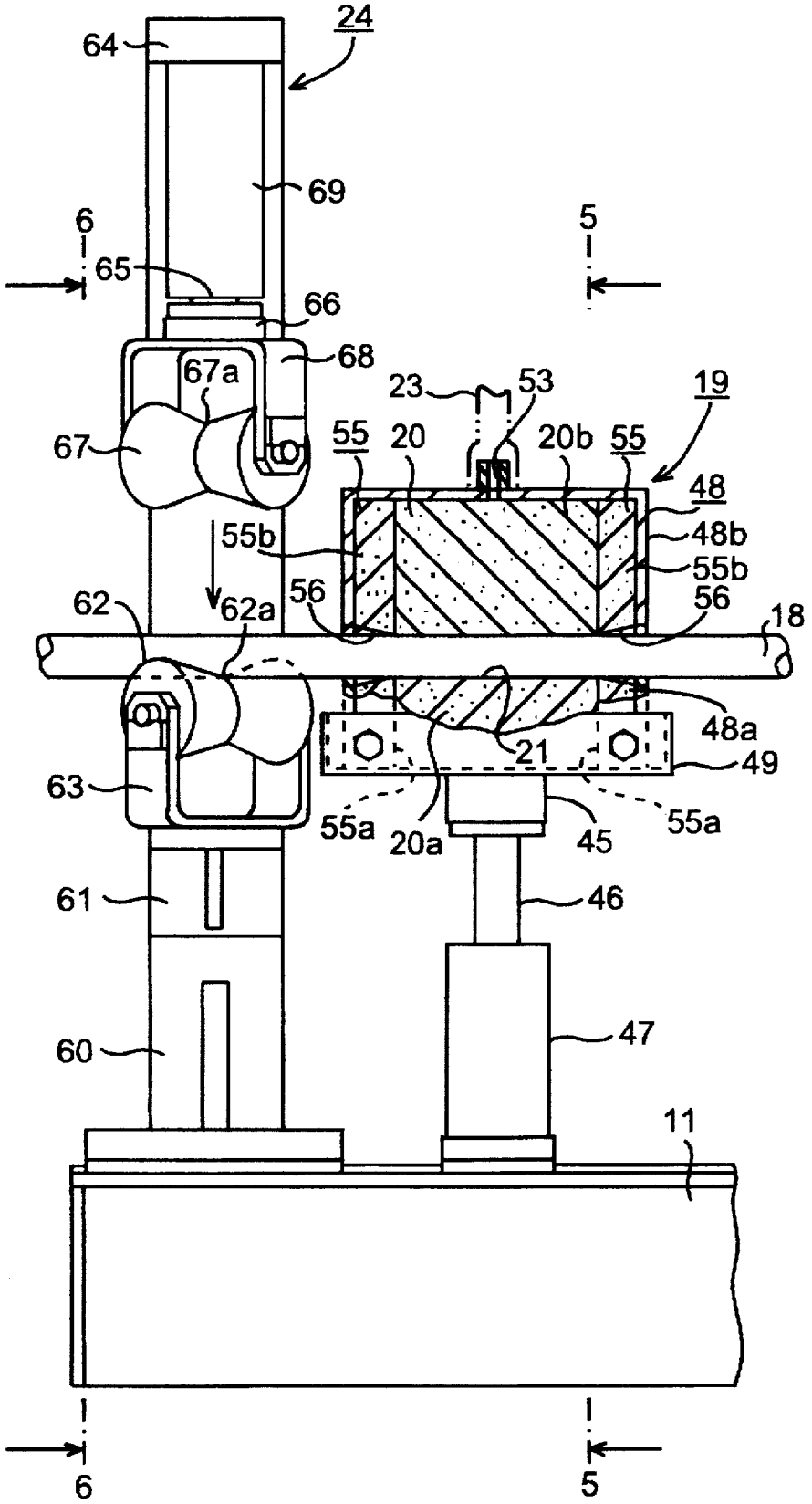
FIG. 4 is a partially broken front view of a coating mechanism and related mechanisms thereof.
Figure 5:
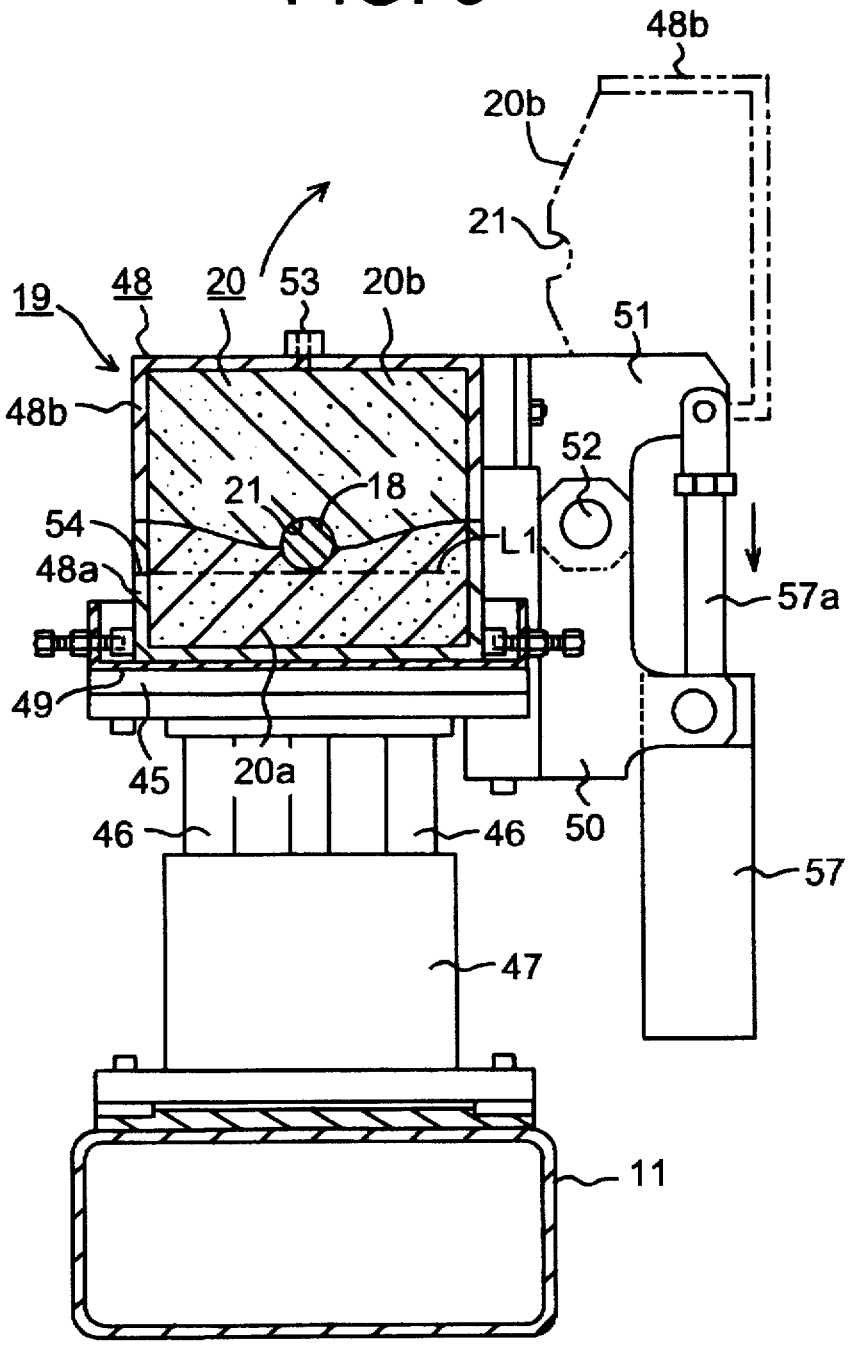
FIG. 5 is a sectional view of FIG. 4 along with a line V—V.

First, the coating mechanism 19 will be explained. As shown in FIGS. 4 and 5, a supporting plate 45 is liftably supported above the machine frame 11 via a pair of guide rods 46 and a lift cylinder 47. The supporting frame 45 is moved, by actuating the lift cylinder 47, between an upper location corresponding to the location of the workpiece 18 and a lower location spaced from that location of the workpiece 18. A receiving vessel 48 is arranged on the upper face of the supporting plate 45 via a receiving tray 49, and is binarily divided into a lower vessel **48*a* and an upper vessel 48*b*. The lower vessel 48*a* is fixed to the supporting plate 45 via the receiving tray 49, and the upper vessel 48*b* is arranged above the lower vessel 48*a* via supporting arms 50 and 51 and a supporting shaft such that the upper vessel 48*b* may be opened or closed relative to the lower vessel 48*a*. At a top portion of the upper vessel 48*b* is formed a feed opening 53 to be connected to a primer feed pipe 23, and at a side wall of the lower vessel 48*a* is formed an overflow opening 54** for overflowing the primer.

The elastic body 20 made of open-cell sponge is vertically and binarily divided into lower and upper elastic members **20*a* and 20*b* along the insertion hole 21. The lower and upper elastic members 20*a* and 20*b* are exchangeably received in the lower and upper vessels 48*a* and 48*b* of the receiving vessel 48, respectively. Sandwiching bodies 55 made of an elastic material such as rubber harder than that of the open-cell sponge are joined to the opposite side faces of the elastic body 20 so that the sandwiching bodies 55 may sandwich the elastic body 20 from opposite sides along the moving direction of the workpiece. In a central portion of each of the sandwiching bodies 55 is formed a through-hole 56 tapered as shown, corresponding to the insertion hole 21 of the elastic body 20. Each sandwiching body 55 is binarily divided into a lower sandwiching member 55*a* and an upper sandwiching member 55*b* along the through-hole 56 as is the same with the elastic body 20**.

An opening/closing cylinder 57 is rotatably supported at the supporting arm 50 fixed to the lower vessel **48*a*, and a piston rod 57*a* is connected to the supporting arm 51 at the upper vessel 48*b*. When the opening/closing cylinder 57** outwardly projects the piston rod 57*a*, the upper vessel 48*b* is turned to a closing position above the lower vessel 48*a* as shown by solid lines in FIG. 5 so that the insertion hole 21 is closedly formed inside the elastic body 20 to allow the insertion of the workpiece 18 therethrough. When the opening/closing cylinder 57 retracts the piston rod 57*a*, as shown by two-dotted lines in FIG. 5, the upper vessel 48*b* is turned to an upper opened location, so that the insertion hole 21 of the elastic body 20 is opened to allow setting and releasing of the workpiece 18 relative to the insertion hole 21.

As shown by a two-dotted line in FIG. 5, the primer fed inside the receiving vessel 48 through the feed opening 53 is stored inside the lower vessel 48*a* at a given level L1, and excess primer is overflown into the receiving tray 49 through the overflow opening 54. In this state, the workpiece 18 is rotated by the rotating mechanism 27 and moved by the moving mechanism 28 through the insertion hole 21 of the elastic body 20. Consequently, the primer is applied to the outer peripheral surface of the workpiece 18 mainly by the lower elastic body 20*a*, and the entire peripheral surface of the workpiece 18 is coated with the primer in a uniform thickness by the upper elastic member 20*b*. The rotating speed of the workpiece 18 by the rotating mechanism and the moving speed of the workpiece 18 by the moving mechanism 28 are so set that the primer may be applied upon the outer peripheral surface of the workpiece 18 twice during the coating.

Figure 6:
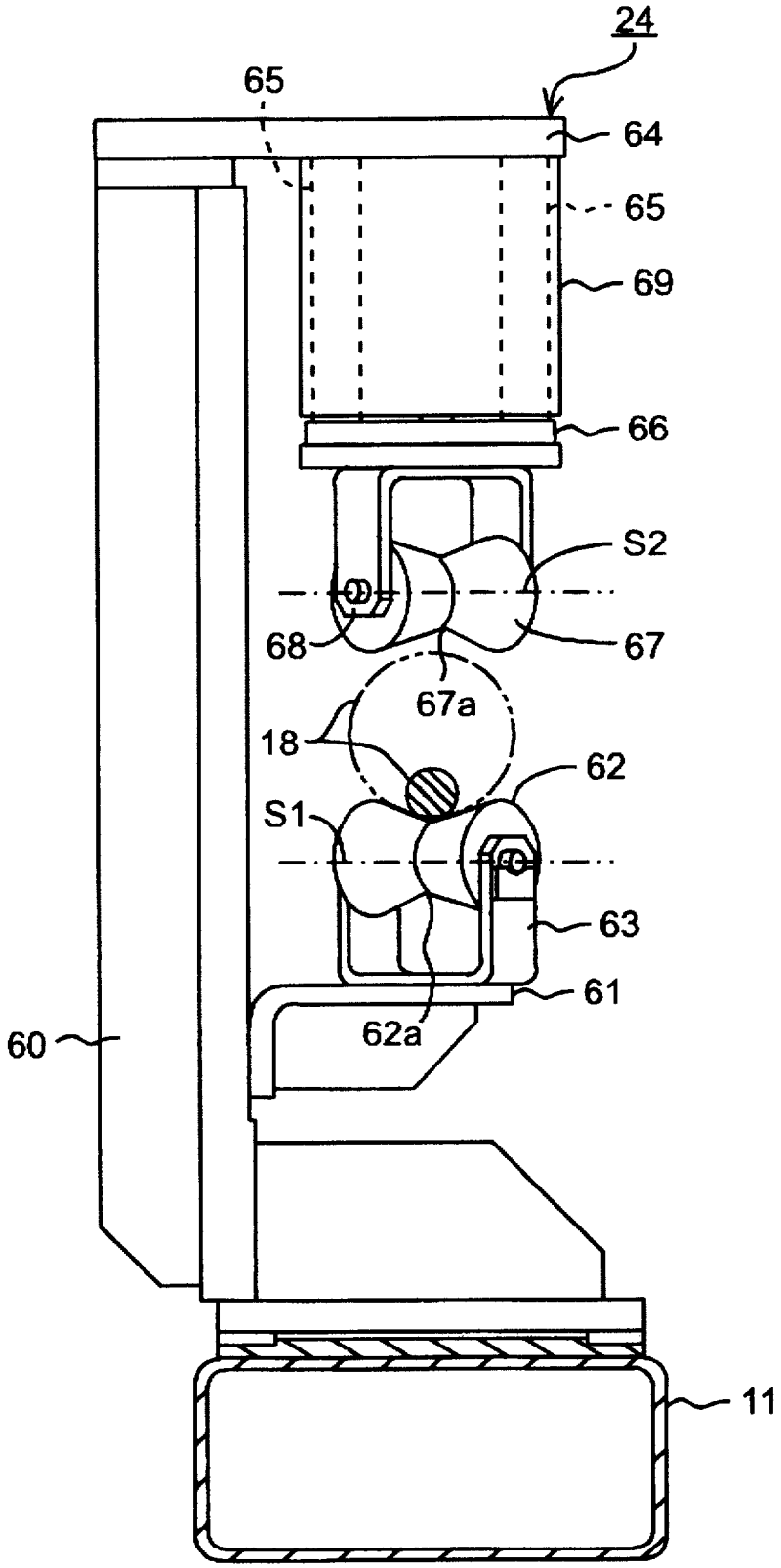
FIG. 6 is a sectional view of FIG. 4 along with a line VI—VI.

Next, the workpiece feeding guide mechanism 24 will be explained. As shown in FIGS. 4 and 6, a bracket 60 is erected on the machine frame 11, and a fitting plate 61 is fixed to a side portion of the bracket 60. A supporting roller 62 is rotatably supported above the fitting plate 61 via a supporting plate 63 such that the supporting roller 62 may be turned around a axis S1 shifted relative to the moving direction of the workpiece 18 at a given angle (45° in this embodiment). The supporting roller 62 has a concaved barrel shape, and an annular recess 62*a* is formed in a central portion of the outer periphery. As shown in FIG. 6, the workpiece 18 is slidably supported by the recess 62*a* of the supporting roller 60, and is led through the insertion hole 21 of the elastic body 20 in the coating mechanism 19.

A fitting plate 64 is fixed to an upper end of the bracket 60, and a lift plate 66 is liftably supported under the fitting plate 64 via a pair of guide rods 65. A press roller 67 is rotatably supported under the lift plate 66 via a supporting plate 68 such that the supporting roller 67 may be turned around a axis S2 shifted relative to the moving direction of the workpiece 18 at a given angle (45° in this embodiment) in an opposite shift direction of the axis S1. As is the same with the supporting roller 62, the supporting roller 67 has a concaved barrel shape, and an annular recess 67*a* is formed in a central portion of the outer periphery.

Under the fitting plate 64 is fitted a lift cylinder 69, which moves up and down the lift plate 66 to displace the press roller 67 away from or near to the supporting roller 62. As the press roller 67 is moved nearer to the supporting roller 62, the press roller 67 is descended down to a location where the recess 67*a* contacts the upper peripheral surface of the workpiece 18 depending upon the outer diameter of the workpiece 18. In this state, the workpiece 18 is sandwiched between the rollers 62 and 67. Further, the press roller 67 is moved apart from the supporting roller 62, the upper side of the supporting roller 62 is opened to allow the setting or detaching of the workpiece 18 relative to the recess 62.

Figure 7:
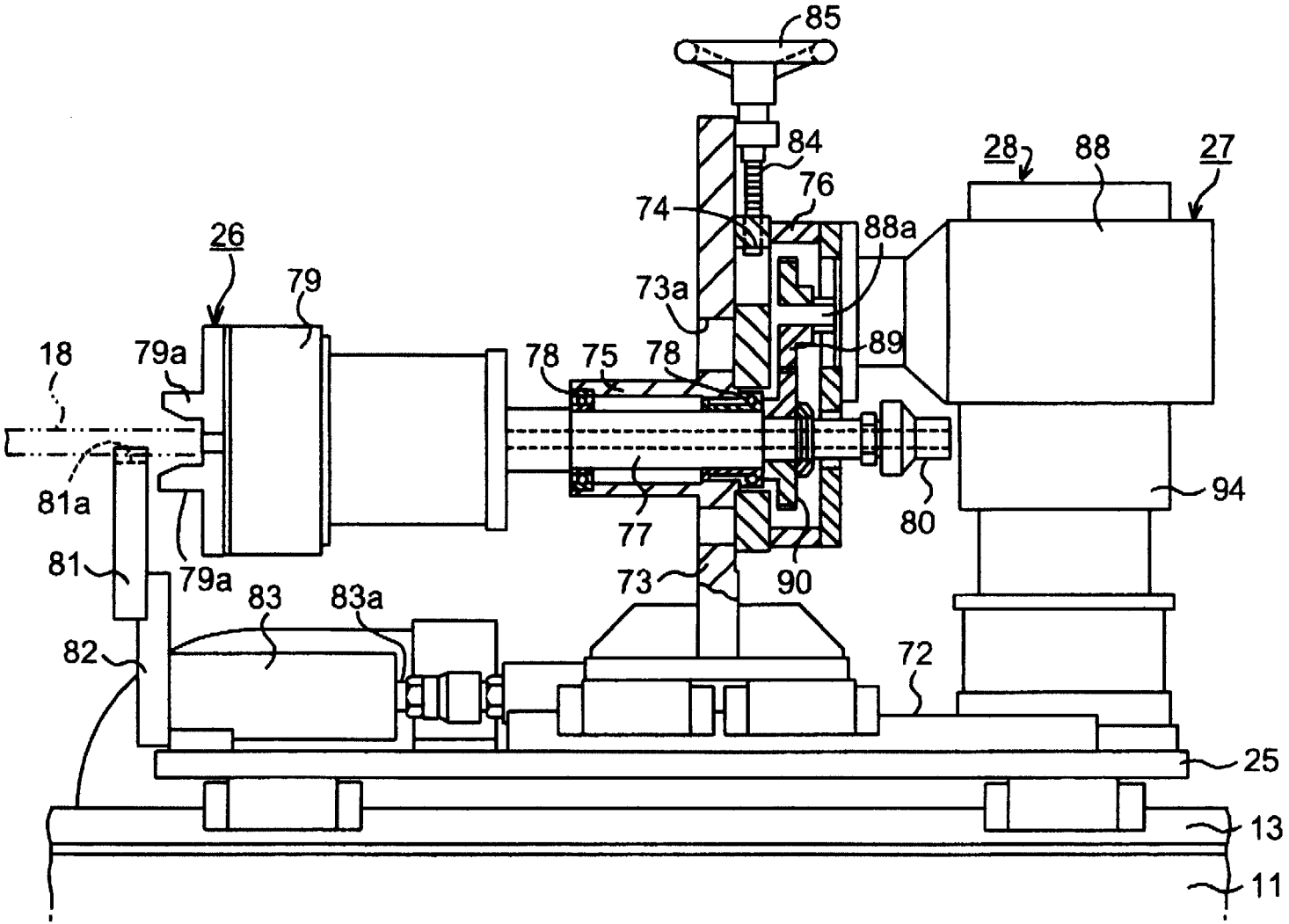
FIG. 7 is a partially broken front view of a moving mechanism and a turning mechanism for the workpiece.
Figure 8:
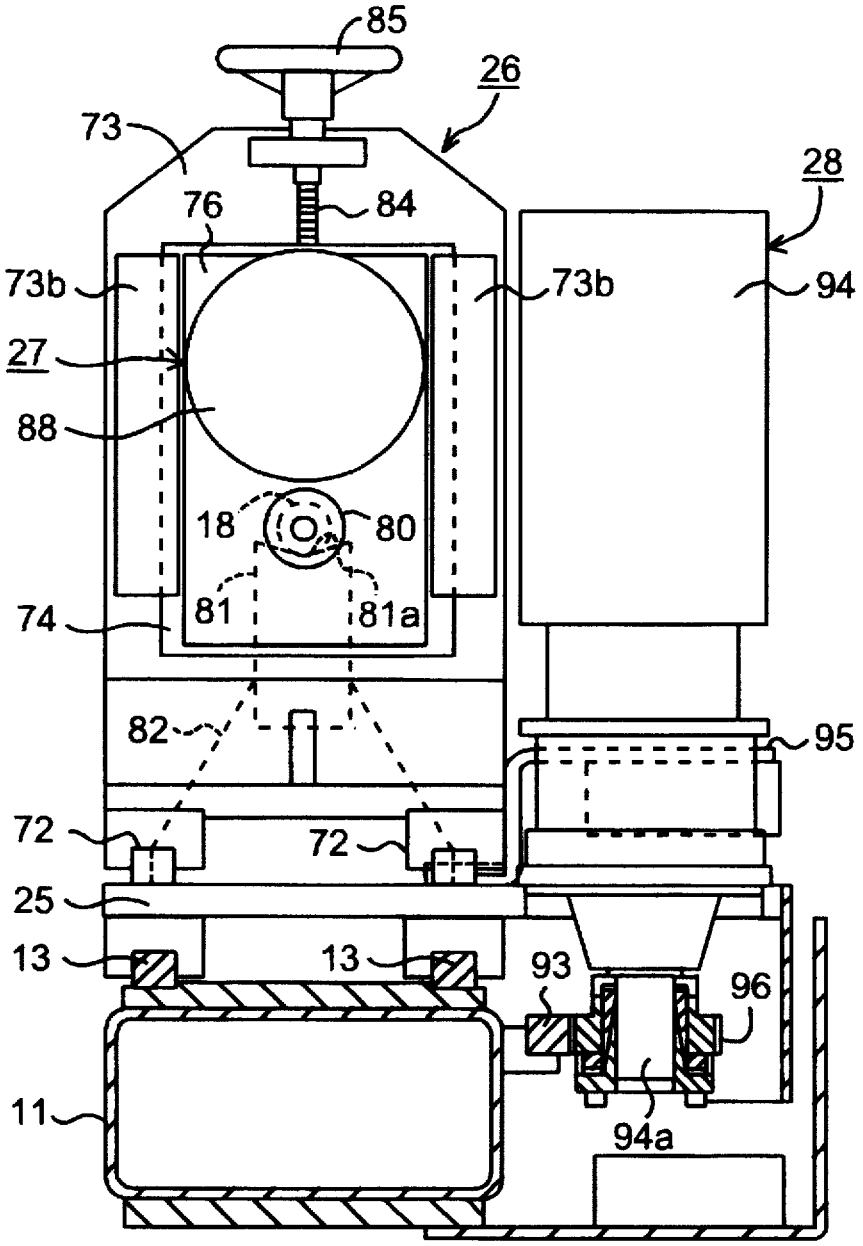
FIG. 8 is a sectional side view of a principal portion of the moving mechanism and the rotating mechanism for the workpiece.

Next, the above workpiece-chucking mechanism 26 will be explained. As shown in FIGS. 7 and 8, a pair of rails 72 are provided on the upper face of the moving table 25, and extends in the same direction of the rails 13 on the machine frame 11. A supporting plate 73 is movably supported upright on the rails 72, and a through-hole 73*a* is formed in a central portion of the supporting plate 73. A pair of guides 73*b* are vertically extended in parallel at side portions of the supporting plate 73. A fitting plate 74 is vertically movably supported between the guides 73*b* of the supporting plate 73, and a bearing cylinder 75 is provided on one side of the fitting plate 74 through the through-hole 73*a*, whereas a gear box 76 is fixed to the other side thereof. A cylindrical rotary shaft 77 is rotatably supported in the bearing cylinder 75 via a pair of bearings 78, and to a tip of the rotary shaft 77 is fitted a chucking head 79 having a plurality of chucking claws 79*a*.

An air port 80 is fitted to a base end of the rotary shaft 77, and air is fed to or discharged from a chuck opening/closing mechanism (not shown) inside the chucking head 79 through the rotary shaft 77 from the air port 80 to open or close the chucking claws 79. When the chucking claws are closed, the starting end portion of the workpiece 18 is chucked between the chucking claws 79. On the other hand, when the chucking claws 79*a* are opened, the workpiece 18 can be set to or detached from between the chuck claws 79*a*.

A guide plate 81 is elected above the moving table 25 via a fitting plate 82, corresponding to the chuck head 79, and at an upper end of the guide plate 81 is provided a V-shaped recess 81*a* for guiding the starting end portion of the workpiece 18 between the chucking claws 79. A moving cylinder 83 is fitted to a side face of the fitting plate 82, and a piston rod 83*a* is connected to the supporting plate 73. When the moving cylinder 83 retracts the piston rod 83*a*, the supporting plate 73 is moved to the left side in FIG. 7 so that the chucking head 79 may be located at a location where the starting end portion of the workpiece 18 is chucked. When the moving cylinder 83 outwardly projects the piston rod 83*a*, the supporting plate 73 is moved to the right side of the in this Figure so that the chucking head 79 may be located at a location where the workpiece 18 is released from the chucking head.

An adjusting screw 84 is rotatably supported by an upper end of the supporting plate 73 and screwed to the fitting plate 74 at a lower end portion, whereas its upper end is provided with an operating handle 85. As the adjusting screw 84 is turned by the operating handle 85, the fitting plate 74, the bearing cylinder 75 and the gear box 76 are vertically and integrally moved so that the axis of the rotary shaft 77 may be aligned with that of the workpiece 18. Therefore, if the outer diameter of the workpiece 18 is changed, the chucking head 79 can be easily moved to a location conforming with the starting end portion of the workpiece 18.

Next, the workpiece-rotating mechanism 27 will be explained. As shown in FIGS. 7 and 8, a rotary motor 88 is fitted to an outer face of the gear box 76, and its motor shaft 88a projects into the gear box 76. A driving gear 89 is fitted to the motor shaft 88, and a driven shaft 90 is fitted to the rotary shaft 77 and meshes with the driving gear 89. While the workpiece 18 is chucked between the chucking claws 79*a* of the chucking head 79, the motor 88 rotates the rotary shaft 77 via both the gears 89 and 90 to exert a rotary force upon the workpiece 18.

Next, the workpiece-moving mechanism 28 will be explained. As shown in FIGS. 7 and 8, a rack 93 is fitted to a side portion of the machine frame 11, and extends in the same direction as the rails 13. A moving motor 94 is arranged above the moving table 25 via a bracket 95, and a motor shaft 94*a* projects from the under face of the motor 94. A pinion 96 is fitted around the motor shaft 94*a* of the moving motor 94, and meshes with the rack 93.

Figure 2:
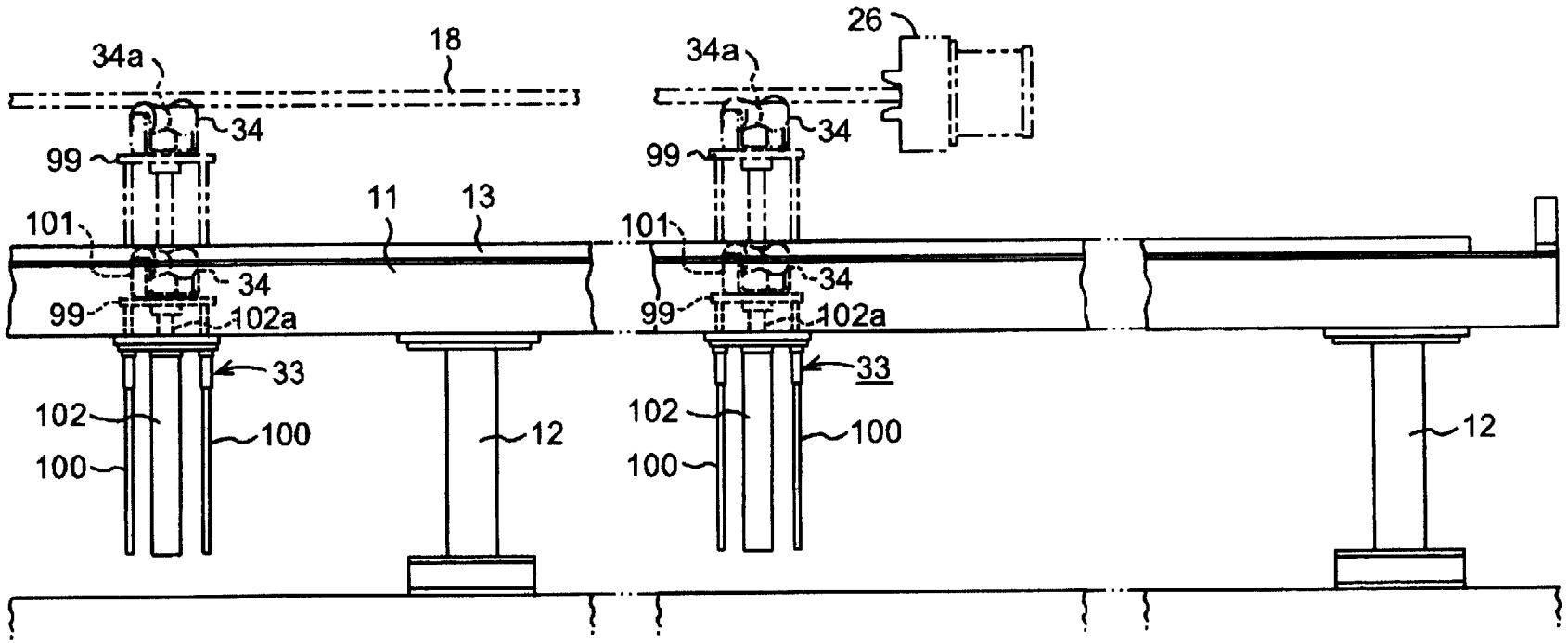
FIG. 2 is a front view of a right side portion of the coating apparatus in FIG. 1.

When the moving motor 94 is rotated in one direction in the state that the workpiece 18 is being chucked between the chucking claws 79*a* of the chucking head 79, the moving table 25 is moved to the right side in FIGS. 1 and 2 via the pinion 96 and the rack 93 so that the workpiece 18 may be moved to the same side. After the workpiece 18 is released from the chucking claws of the chucking head 79 at the location of the movement terminal end, the moving motor 94 is rotated in the reverse direction so that the moving table 25 may be moved back to the original position via the pinion 96 and the rack 93.

Next, the work-moving guide mechanism 33 will be explained. As shown in FIGS. 1 to 3, a lift plate 99 is vertically movably supported by the machine frame 11 via a pair of guide rods 100. The above supporting roller 34 is supported above the lift plate 99 via a supporting plate 101 such that the supporting roller 34 may be rotatable around an axis S3 shifted at a given angle (45° in this embodiment), relative to the moving direction of the workpiece 18, in the same direction of the supporting roller 62 of the feeding guide mechanism 24.

A lift cylinder 102 is fitted to the under face of the machine frame 11, and its piston rod 102*a* is connected to the lift plate 99. While the workpiece 18 is being moved by the moving mechanism 28, the primer is applied around the outer peripheral surface of the workpiece 18. At that time, as shown by the two-dotted lines in FIG. 2, every time the moving table 25 passes above each moving guide mechanism 33, the lift cylinder 102 outwardly projects the piston rods 102*a* to move up the lift plate 99. By so doing, the workpiece 18 is supported by the recess 34*a* of the supporting roller 34 having the almost concaved barrel shape, while its coated surface does not largely contact the supporting roller 34.

The operation of the primer-coating apparatus thus constructed will be explained.

When a workpiece-setting switch on an operation panel not shown is turned on, in the coating mechanism 19, the receiving vessel 48 is moved downwardly to its lower position by the lift cylinder 47, and the upper vessel 48*b* is turned to its open location above the lower vessel 48*a* by the lift cylinder 47. In the chucking mechanism 26, the chucking head 79 is moved to the left chucking position from its original position shown in FIG. 1 by the moving cylinder 83. At that time, the chucking claws 79*a* of the chucking head 79 are kept opened.

In this state, the workpiece 18 is fed and set between the chucking claws 79 of the chucking head 79 in the chucking mechanism 26 through both the vessels 48*a* and 48*b* in the coating mechanism 19 by means of the roller conveyor 17 of the workpiece-feeding mechanism 14. Thereafter, when a start switch on the operation panel not shown is turn on, in the coating mechanism 19, the receiving vessel 48 is moved from its lower position to its upper position by the lift cylinder 47, and the upper vessel 48*b* is turned to its closing position above the lower vessel 48*a* by the opening/closing cylinder 57. By so doing, the upper elastic member 20*b* is closely contacted with the lower elastic member 20*a* so that the through hole 21 may be formed between both the elastic members 20*a* and 20*b*. The workpiece 18 is inserted through the insertion hole 21.

At that time, air is fed to the not shown opening/closing mechanism inside the chucking head 79 in the chucking mechanism 26 from the air port 80 through the rotary shaft 77 to close the chucking claws 79*a*. Thereby, the start end portion of the workpiece 18 is chucked between the chucking claws 79*a*. In the workpiece-feeding guide mechanism 24, the pressing roller 67 is moved down by the lift cylinder 69 so that the workpiece 18 may be sandwiched between the supporting roller 62 and the pressing roller 67.

In this state, the primer is fed into the receiving vessel 48 of the coating mechanism from the primer tank 22 to immerse the elastic body 20. While the moving mechanism 28 is kept stopped, the rotary shaft 77 is turned by the rotating motor 88 of the rotating mechanism 27 so that the workpiece 18 may be turned via the chucking head 79 for a given time period only. By so doing, the primer is wet-coated on the outer peripheral surface of the workpiece 18 in the state that the workpiece contacts the inner periphery of the insertion hole 21 of the elastic body 20. At that time, as shown in FIG. 1, since the elastic body 20 of the coating mechanism 19 slidably contacts the workpiece 18 at a location spaced from the starting end by a given distance, a portion P2 not coated with the primer is formed around the outer peripheral surface of the starting end of the workpiece 18.

After a predetermined time lapses following the start of the coating, the moving table 25 is moved rearwardly (to the right in FIGS. 1 to 3) by the moving motor 94 to move the workpiece 18 in the same direction. Consequently, while the workpiece 18 is being rotated, it is moved relative to the elastic body 20 of the coating mechanism 19 through the insertion hole 21, so that the primer impregnated into the elastic body 20 is successively wet-on-wet coated twice onto the outer peripheral surface of the workpiece 18. At that time, hot air is blown upon the primer-coated surface of the workpiece 18 through the feed duct 32 from the hot air generating mechanism 29, so that the primer applied onto the outer peripheral surface of the workpiece 18 is dried in a short time.

When the moving table 25 passes above the moving guide mechanism 32 during coating the primer around the workpiece 18, as shown in FIG. 2 by the two-dotted lines, the almost barrel-shaped supporting roller 34 is moved up by the lift cylinder 102 of the moving guide mechanism 33. Therefore, as the workpiece 18 is moved rearwardly, it is successively supported by the recesses 34*a* of the supporting rollers 34 of the moving guide mechanisms 33 while the coated surface of the workpiece is not largely contacted with the supporting rollers 34.

As shown in FIG. 3 by the two-dotted lines, when the terminal end portion of the workpiece 18 is opposed to the first sensor 36 of the workpiece-detecting mechanism 35, the light-receiving element 36*b* outputs a detection signal, based on which the moving speed of the moving mechanism 28 is reduced. Thereafter, when the terminal end portion of the workpiece 18 is opposed to the second sensor 37, the light-receiving element 37*b* outputs a detection signal. Based on this detection signal, the movement of the moving mechanism 28 is stopped, and the operation of the hot air generating mechanism 29 is stopped. As a result, while the workpiece 18 is merely rotated, the primer is wet-on-wet coated upon the workpiece 18 at a location spaced from the terminal end by a given distance, the portion P1 of the workpiece being not coated with the primer.

After a predetermined time lapses following the stoppage of the moving mechanism 28, the rotating mechanism 27 is stopped. At that time, in the coating mechanism 19, the upper vessel 48*b* is turned to the open location above the lower vessel 48*a* by the opening/ closing cylinder 57, while the receiving vessel 48 is moved to its lower position by the lift cylinder 24. In the workpiece feeding guide mechanism 24, the press roller 67 is moved up apart from the upper outer peripheral surface of the workpiece by the lift cylinder 69.

In the chucking mechanism 26, feeding of air into the opening/closing mechanism inside the chucking head 79 is stopped, so that the chucking claws 79*a* are opened to release the chucking of the workpiece 18. Thereafter, the supporting plate 73 is moved to the right side in FIGS. 1 and 7 by the moving cylinder 83, and the chucking head 79 is moved to a location spaced from the starting terminal end of the workpiece 18. Therefore, in this state, the completely coated workpiece 18 can be easily taken out above from the support rollers 34 of the moving guide mechanism 33.

Then, when the return switch on the operation panel not shown is turned on, the supporting plate 73 is moved to the left side in FIGS. 1 and 7 by the moving cylinder 83 of the chucking mechanism 26, so that the chucking head 79 is returned to the position for chucking the workpiece 18. At that time, the moving table 25 is moved forwardly (to the left side in FIGS. 1 to 3) by the moving motor 94 of the moving mechanism 28, the chucking mechanism 26, the rotating mechanism 27 and the moving mechanism 28 are returned to their respective original positions.

When the dog 39 of the movement detecting mechanism 38 is opposed to the second approach switch 41 during the above returning operation, the second approach switch 41 outputs a detection signal, based on which the returning speed of the moving mechanism 28 is reduced. Then, when the dog 39 is opposed to the third approach switch 42, the third approach switch outputs a detection signal, based on which the returning operation of the moving mechanism 28 is stopped. In this state, an original point-indicating lamp is lit on the operation panel not shown, and the apparatus waits for setting of a next workpiece 18.

As mentioned above, according to this embodiment of the primer-coating apparatus, while the rod-shaped workpiece 18 is inserted through the insertion hole 21 in the central portion of the elastic body 20, the workpiece and the elastic body 20 are moved relative to each other by the moving mechanism 28 to coat the primer impregnated into the elastic body 20 around the workpiece 18. Therefore, the primer can be coated around the outer peripheral surface of the workpiece 18 in a short time to enhance the workability. Further, the coating quality can be improved.

In addition, according to this embodiment of the primer-coating apparatus, when the workpiece 18 is to be coated with the primer, it is moved relative to the elastic body 20 by the moving mechanism 28 in the longitudinal direction, while being rotated by the rotating mechanism 27. Therefore, the primer can be uniformly coated upon the outer peripheral surface of the workpiece 18 in a shorter time period with the result that the workability and the coating quality can be enhanced.

Furthermore, according to this embodiment of the primer-coating apparatus, as the workpiece 18 is coated with the primer, the sensor 37 outputs a detection signal when the elastic body 20 comes to be opposed to a given location of the workpiece spaced from the end of the workpiece 18 by a predetermined distance. Consequently, the moving mechanism 28 is stopped based on this detection signal. Therefore, the portion not coated with the primer can be easily formed around the outer peripheral surface of the end of the workpiece 18 without necessity of adhering a masking tape therearound.

Further, according to this embodiment of the primer-coating apparatus, since the elastic body 20 is binarily divided into the lower elastic member 20*a* and the upper elastic member 20*b*, the insertion hole 21 can be opened by separating the upper elastic member 20*b* from the lower elastic member 20*a*. Therefore, while the insertion hole 21 is kept open, the workpiece 18 can be easily attached to or detached from the insertion hole 21.

Furthermore, according to this embodiment of the primer-coating apparatus, since the elastic body 20 is made of the open-cell type sponge, the primer can be fully impregnated into the entire elastic body 20. Therefore, the outer peripheral surface of the workpiece 18 can be uniformly coated with the elastic body 20 into which the primer is fully impregnated.

In addition, according to this embodiment of the primer-coating apparatus, the elastic body 20 made of the open-cell type sponge is held between the sandwiching members 55 made of a material harder than the open-cell type sponge from the opposite side faces. Therefore, the shape of the elastic body 20 can be prevented from being deformed due to the relative movement between the workpiece 18 and the elastic body 20 during the coating.

Furthermore, according to this embodiment of the primer-coating apparatus, when the primer is coated upon the outer peripheral surface of the workpiece 18 in the state that the workpiece 18 is being moved relative to the elastic body 20 by the moving mechanism 28, the almost barrel-shaped supporting rollers 34 are successively moved up to the moving path of the workpiece 18. Accordingly, the primer-coated workpiece 18 can be supported by the recesses 34*a* in the central portions of the outer peripheral faces of the respective supporting rollers 34 without being largely contacted with the support rollers. In addition, since the supporting roller 62 and the press roller 67 are inclined relative to the workpiece-passing path reversely at 45°, the workpiece 18 can be effectively prevented from slipping from the supporting roller.

Further, according to this embodiment of the primer-coating apparatus, the primer is coated upon the outer peripheral surface of the workpiece 18 when the workpiece 18 passes the insertion hole 21 of the elastic body 20, and then hot air is fed upon the primer-coated surface of the workpiece 18 by the hot air generating mechanism 29. Therefore, the primer coated around the outer peripheral surface of the workpiece 18 can be dried in a short time.

Modifications of the present invention can be made as follows.

(a) Contrary to the above embodiment, the workpiece 18 is not moved, but instead the coating mechanism 18 with the elastic body 20 is moved by the moving mechanism 28 in the longitudinal direction of the workpiece 18 so that the primer impregnated into the elastic body 20 may be coated upon the outer peripheral surface of the workpiece 18.

(b) By rotating the roller conveyors 17 of the workpiece feeding mechanism 14 with use of a driving source such as a motor, the workpiece 18 can be automatically set to the coating mechanism 18 and the chucking mechanism 26.

(c) A workpiece discharging mechanism is arranged in parallel on a rear side of the machine frame 11 so that the workpiece 18 finishing its coating step and released from the chucking mechanism 26 may be automatically discharged from the work moving guide mechanism 33.

(d) An adhesive or a paint is used instead of the primer as the coating agent.

(e) A cylindrical workpiece is coated instead of the rod-shaped workpiece.

In the following, the technical ideas encompassed by the present invention which can be grasped based on the above-mentioned embodiment will be explained.

(1) The open-cell type sponge is received in the receiving vessel, and the receiving vessel is provided with the overflow opening to overflow the excess amount of the covering material impregnated into the open-cell type sponge. By so constructing, the covering material impregnated into the open-cell type sponge can be set at a given level inside the sponge so that the workpiece may be appropriately coated with the covering material.

(2) The supporting rollers are provided at plural locations, and each supporting roller is moved up when the coated workpiece passes above the supporting roller. By so constructing, the coated workpiece can be smoothly supported.

(3) The moving speed at which the workpiece is moved by the moving mechanism and the rotating speed at which the workpiece is rotated by the rotating mechanism are so set that the outer peripheral surface of the workpiece is wet-on-wet coated with the covering material. By so doing, the workpiece can be fully and assuredly coated with the covering material without leaving a uncoated outer peripheral surface portion of the workpiece.

(4) A pair of the upper and lower almost concaved cylindrical supporting rollers each having a recessed portion at a central outer periphery are provided to sandwich the workpiece to be passed through the insertion hole. By so constructing, the workpiece can be smoothly fed into the insertion hole of the elastic body.

(5) A pair of the above upper and lower almost concaved cylindrical supporting rollers have their rotary axes inclined relative to the moving path of the workpiece in reverse directions. By so constructing, the workpiece can be prevented from being slid so that the workpiece can be assuredly fed through the insertion hole of the elastic body.

What is claimed is:

1. A coating apparatus for coating an outer peripheral surface of a core member of an insulator with a covering material, comprising:

an elastic body having an inpregnatable covering material and provided with an insertion hole through which the core member is to be passed, a moving mechanism for moving the core member relative to the elastic body longitudinally through the insertion hole, and a rotating mechanism for rotating the core member, wherein the outer peripheral surface of the core member is coated with the covering material impregnated in the elastic body, when the core member is passed through the insertion hole of the elastic body by the moving mechanism and rotated by the rotating mechanism.

2. The coating apparatus set forth in claim 1, which further comprises a core member-detecting mechanism for detecting an end portion of the core member and outputting a detection signal upon detection of said end portion of the core member so that the core member-moving mechanism may be stopped at a place corresponding to a location where the elastic body is spaced from the end portion of the core member by a given distance, thereby to stop the relative movement between the core member and the elastic body and to not coat an outer peripheral surface of the end portion of the core member with the covering material.

3. The coating apparatus set forth in claim 1, wherein said elastic body includes two elastic members divided along the insertion hole so that said insertion hole may be opened by spacing the elastic members from each other.

4. The coating apparatus set forth in claim 1, wherein said elastic body comprises an open-cell type sponge.

5. The coating apparatus set forth in claim 3, wherein said elastic body comprises an open-cell type sponge.

6. The coating apparatus set forth in claim 4, wherein said elastic body is sandwiched by a sandwiching member from opposite sides of the elastic body as viewed in a moving direction of the core member, said sandwiching member being made of a material harder than the open-cell type sponge.

7. The coating apparatus set forth in claim 5, wherein said elastic body is sandwiched by a sandwiching member from opposite sides of the elastic body as viewed in a moving direction of the core member, said sandwiching member being made of a material harder than the open-cell type sponge.

8. The coating apparatus set forth in claim 1, which further comprises a concaved cylindrical supporting roller having a recessed portion at a central portion of an outer periphery thereof, said supporting roller being moved up and down to support the core member coated with the covering material.

9. The coating apparatus set forth in claim 1, which further comprises a hot air generating mechanism arranged downstream, from the elastic body to dry the covering material coated upon the outer peripheral surface of the core member.

10. The coating apparatus set forth in claim 1, which further comprises a core member feeding mechanism and a core member feeding guide mechanism, said core member feeding guide mechanism being adapted for feeding the core member to the elastic body and said core member feed guide mechanism being adapted for guiding a forward end of the core member into the insertion hole of the elastic body.

11. The coating apparatus set forth in claim 1, which further comprises a chucking mechanism for chucking a forward end portion of the core member, said chucking mechanism being moved by said core member-moving mechanism to pass the core member through the insertion hole of the elastic body.

12. The coating apparatus set forth in claim 1, which further comprises a moving mechanism movement-detecting mechanism for detecting a location where the coating of the core member with the covering material through the insertion hole of the elastic body is to be terminated so as to stop the core member-moving mechanism.

* * * * *